United States Patent [19]

Matsushima et al.

[11] Patent Number: 4,623,004

[45] Date of Patent: Nov. 18, 1986

[54] WOVEN SLIDE FASTENER STRINGER

[75] Inventors: Haruo Matsushima; Yuuji Yamase, both of Kurobe, Japan

[73] Assignee: Yoshida Kogyo K. K., Tokyo, Japan

[21] Appl. No.: 805,804

[22] Filed: Dec. 6, 1985

[30] Foreign Application Priority Data

Dec. 6, 1984 [JP] Japan ..... 59-185405[U]

[51] Int. Cl.[4] ..... A44B 19/10

[52] U.S. Cl. ..... 139/384 B; 24/392; 24/393

[58] Field of Search ..... 139/384 B; 24/391, 392, 24/393, 394

[56] References Cited

U.S. PATENT DOCUMENTS

| | | | |
|---|---|---|---|
| 3,941,163 | 3/1976 | Glindmeyer et al. | 139/384 B |
| 4,188,982 | 2/1980 | Yoshida et al. | 24/392 |
| 4,191,220 | 3/1980 | Yoshida | 139/384 B |
| 4,210,180 | 7/1980 | Tsubata | 139/384 B |
| 4,215,729 | 8/1980 | Ofusa | 139/384 B |
| 4,220,182 | 9/1980 | Glindmeyer et al. | 139/384 B |
| 4,231,139 | 11/1980 | Tsubata | 24/392 |
| 4,254,803 | 3/1981 | Tsubata | 139/384 B |
| 4,383,558 | 5/1983 | Tsubata et al. | 139/384 B |

FOREIGN PATENT DOCUMENTS

| | | |
|---|---|---|
| 46-7018 | 2/1971 | Japan . |
| 56-60504 | 5/1981 | Japan . |

*Primary Examiner*—Henry S. Jaudon

*Attorney, Agent, or Firm*—Hill, Van Santen, Steadman & Simpson

[57] ABSTRACT

In a woven slide fastener stringer of the type which comprises a row of successively interconnected elongated loops of a plastic filament woven into a longitudinal edge of a stringer tape woven of foundation warp and weft threads, and a pair of groups of upper and lower binding warp threads extending respectively over and under the loops and interwoven with the foundation weft thread, the improvements comprising a gap-filling warp thread extending parallel with and between an outermost one of the upper binding warp threads and the next adjoining upper binding warp thread and also between an outermost one of the lower binding warp threads and the next adjoining lower binding warp thread, and passing alternately over and under the foundation weft thread, thereby tensioning the latter thread to sink substantially halfway between the upper and lower legs of each adjacent pair of loops. Preferably, the outermost upper and lower binding warp threads are disposed in registry with each other to make the foundation weft thread lie substantially perpendicualr to the plane of the fastener stringer between the two outermost binding warp threads. The row of loops thus woven is stably secured in place against angular displacement and held at the proper pitch with respect to individual adjacent loops.

6 Claims, 3 Drawing Figures

WOVEN SLIDE FASTENER STRINGER

BACKGROUND OF THE INVENTION

1. Field of the Invention

This invention relates to a slide fastener and has particular reference to a fastener stringer having a continuous plastic filament spirally formed and woven into a longitudinal edge of a stringer tape simultaneously as the latter is woven.

2. Prior Art

There have been proposed a number of slide fasteners or zippers of the type described, which comprise a woven stringer tape and a plastic filament woven into a longitudinal edge of the tape, the filament being usually formed into a helical coil structure composed of a succession of loops or elongated convolutions each having a coupling head, an upper and a lower leg and a connecting portion.

When bent into such helical coil formation, the filament which is thicker and harder than the weave yarn tends to yield back, thereby causing the fastener stringer to stretch longitudinally and causing the filament loops to tilt away from an upright posture with respect to the plane of the stringer tape. This displacement of the fastener and filament loops would result in irregular pitch of the filament loops, which in turn hinders smooth closing and opening operation of the slide fastener.

A means is disclosed in Japanese Patent Publication No. 46-7018 for eliminating the tendency of the individual coil loops to tilt away from their desirably upright posture, the means comprising a dense array of warp threads along a tape edge into which the filament is woven. This prior art, however, still has a drawback in that the fastener stringers are susceptible to longitudinal stretch and hence unstable in the loop-to-loop pitch of the filament.

Disclosed in Japanese Patent Laid-Open Publication No. 56-60504 is a woven fastener stringer having binding warp threads extending over every two coil loops and underlying a foundation weft in double pick between adjacent loops thereby forming a pad-like structure between the upper and lower legs of the loops so as to improve resistance to tortion of the filament loops and to stabilize the inter-loop pitch. This stringer structure having binding warp threads bundled up by weft threads would become extremely thick and heavy and hence less flexible.

SUMMARY OF THE INVENTION

It is an object of the present invention to provide a woven stringer for a slide fastener having a row of successively interconnected elongated loops or convolutions formed from a plastic filament and woven into a stringer tape, the row of loops being stably secured in place against tilting or angular displacement and held at the proper pitch with respect to individual adjacent loops.

It is another object of the invention to provide a woven fastener stringer having a row of elongated loops secured to the tape in such a manner that the loops may assume improved posture for coupling engagement.

According to the invention, a woven slide fastener stringer comprises a row of successively interconnected elongated loops of a plastic filament woven into a longitudinal edge of a stringer tape woven of foundation warp and weft threads, a pair of groups of upper and lower binding warp threads extending respectively over and under the loops and interwoven with the foundation weft thread, and a gap-filling warp thread extending parallel with and between an outermost one of the upper binding warp threads and the next adjoining upper binding warp thread and also between an outermost one of the lower binding warp threads and the next adjoining lower binding warp thread, and passing alternately over and under the foundation weft thread, thereby tensioning the latter thread to sink substantially halfway between the upper and lower legs of each adjacent pair of loops. Preferably, the outermost upper and lower binding warp threads are disposed in registry with each other to make portions of the foundation weft thread lie substantially perpendicularly to the plane of the fastener stringer. The row of loops thus woven is stably secured in place against tilting or angular displacement and held at the proper pitch with respect to individual adjacent loops.

Other advantages and features of the present invention will become manifest to those versed in the art upon making reference to the detailed description and the accompanying sheets of drawings in which preferred structural embodiments incorporating the principles of the present invention are shown by way of example.

DETAILED DESCRIPTION

Figure 1:
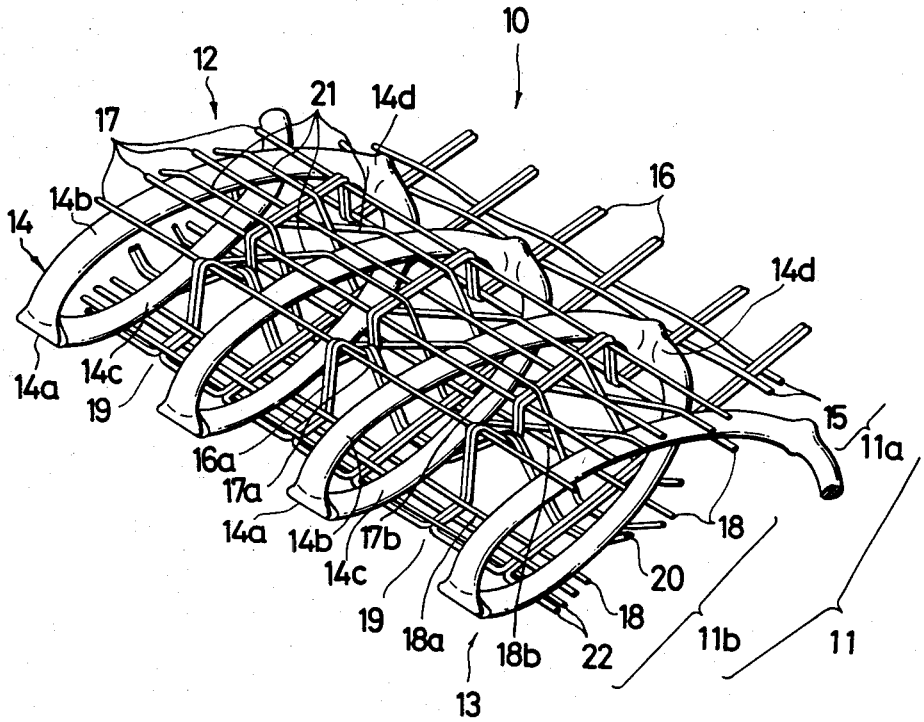
FIG. 1 is a diagrammatic perspective view on enlarged scale of a woven slide fastener stringer provided in accordance with the invention.

A fastener stringer generally designated 10 constitutes one part of a pair of identical stringers for a slide fastener. The stringer 10 includes a woven stringer tape 11 having a generally flat web section 11*a* (only partly shown) defining a major dimension of the stringer tape 11 and a filament woven section 11*b* defining a longitudinal edge portion 12 of the stringer tape 11 into which a filament 13 of plastic material is laid in double pick and woven in the form of a row of successively interconnected elongated loops each of which serves as a fastener coupling element.

Each loop or elongated convolution 14 of the filament 13 has a coupling head 14*a* at one end thereof, an upper leg 14*b* and a lower leg 14*c* extending from the head 14*a* in a common direction and a heel portion 14*d* remote from the head 14*a* connected to a next adjacent one of the successive loops 14. The coupling head 14*a* is dimensioned to releasably couple with a corresponding head of a loop 14 on a mating stringer to open and close the fastener in a well known manner.

The web section 11*a* of the stringer tape 11 may be of any known design having foundation warp threads 15 and a foundation weft thread 16 interwoven in a variety of patterns, which will require no further explanation as this has no direct bearing upon the invention.

In the filament woven section 11*b* of the stringer tape 11, there are provided a group of upper binding warp threads 17 extending in parallel longitudinally of the stringer tape 11 and overlying the upper legs 14*b* of successive filament loops 14, and a group of lower binding warp threads 18 extending in parallel longitudinally of the stringer tape 11 and underlying the lower legs 14*c* of successive loops 14, both groups of binding warp threads 17, 18 running as a whole substantially along a straight path at the region of the legs 14*b*, 14*c* which extends substantially from the midpoint of each of the upper and lower legs 14*b*, 14*c* to the heel portions 14*d*. The foundation weft thread 16 is laid in double pick and interwoven with the foundation warp threads 15 to form the web section 11*a*. In the filament woven section 11*b*, the foundation weft thread 16 is interwoven with the upper and lower binding warp threads 17, 18 to form loops in the spaces between each adjacent pair of loops 14 or in each of successive ones of inter-loop spaces 19.

Figure 2:
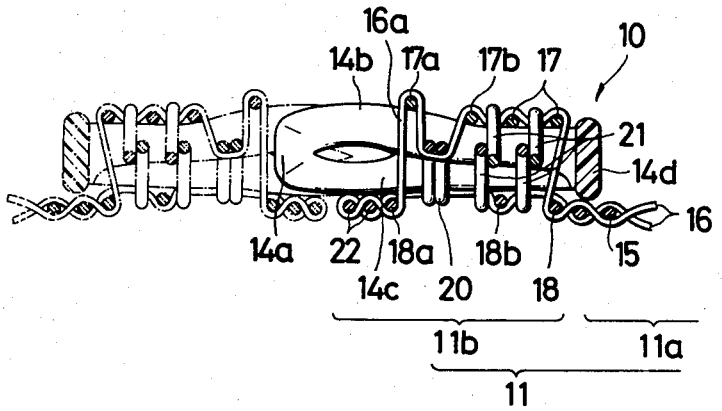
FIG. 2 is a transverse cross-sectional view of the slide fastener stringer shown in FIG. 1.

A pair of gap-filling warp threads 20, which is laid preferably in juxtaposition as shown, extends parallel with and between a first or outermost upper binding warp thread 17*a* and a second or next adjoining upper binding warp thread 17*b* and also between a first or outermost lower binding warp thread 18*a* and a second or next adjoining lower binding warp thread 18*b*, and passes alternately over and under the continuous foundation weft thread 16 in the inter-loop spaces 19 and underlie the lower legs 14*c* of the filament loops 14. The foundation weft thread 16 is tensioned by the gap-filling threads 20. Since the gap-filling warp threads 20 underlie the lower legs 14*c* and the foundation weft thread 16 but do not overlie the upper legs 14*b*, upper portions of the respective loops of the foundation weft thread 16 are drawn to sink almost halfway between the upper and lower legs 14*b* and 14*c* in the interelement spaces 19, as shown in FIG. 2. As a result, the spaces 19 between adjacent loops 14 are substantially closed to retain the position of all the loops 14 substantially upright or at a right angle to the plane of the fastener as desired for smooth coupling operation of the fastener. The first upper binding warp thread 17*a* is disposed substantially in registry with the corresponding first lower binding warp thread 18*a* so that the portions 16*a* of the foundation weft thread 16 which span between these warp threads 17*a* and 18*a* are oriented to lie substantially perpendicularly to the plane of the fastener stringer 10, thereby clearly defining an open area required for smooth and accurate coupling engagement of the coupling heads 14*a* of adjacent loops 14.

A plurality of loop-clamping warp threads (four in the illustrated embodiment) 21 are provided for clamping interconnected successive loops 14 of the coupling filament 13 in place against displacement which would otherwise take place when the fastener is subjected to bending or other external stresses. As better shown in FIG. 2, the loop-clamping warp threads 21 bring the upper and lower legs 14*b*, 14*c* of each loop 14 closely together so that the loops 14 may assume stable posture with respect to the stringer tape 11. The loop-clamping warp threads 21 extend parallel with and between the remaining upper and lower binding warp threads 17, 17*b* and 18, 18*b* except the outermost two threads 17*a*, 18*a*, and alternately overlie the upper legs 14*b* and the foundation weft thread 16 and underlie the lower legs 14*c* and the foundation weft thread 16 so as to form a 1/1 weave structure with the filament 13 and a 2/2 weave structure with the foundation weft thread 18. The upper loop-clamping warp thread 21 and the lower loop-clamping warp threads 21 extend in a symmetric pattern. These weave structures provide a stable loop-to-loop pitch of the filament loops 14.

A plurality of anchoring warp threads (two in the illustrated embodiment) 22 underlie the lower legs 14*c* of the loops 14 adjacent to the coupling heads 14*a* and are interwoven with the foundation weft thread 16 to form a supporting anchor for the filament loops 14 to prevent the latter from leaning downwardly away from the plane of the fastener stringer 10.

Figure 3:
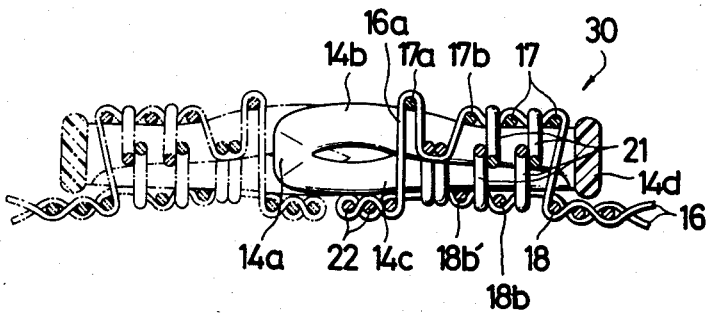
FIG. 3 is a view similar to FIG. 2 but showing a modified form of woven slide fastener stringer according to the invention.

FIG. 3 shows a modified woven fastener stringer 30 according to the invention which is substantially the same as the stringer 10 shown in FIGS. 1 and 2, except that there is provided one additional lower binding warp thread 18*b*′ disposed between the outermost lower binding warp thread 18*a* and the next adjoining binding warp thread 18*b*.

As it appears obvious from the scope of the appended claims and to those skilled in the art, there may be made various changes and modifications in the specific embodiments herein shown and described. As for an example, the number of upper and lower binding warp threads 17 and 18 or clamping warp threads 21 may be varied according to the size of the slide fastener desired.

What is claimed is:

1. A woven slide fastener stringer comprising:

(a) a woven stringer tape formed with foundation warp threads and a weft thread and having a filament woven section defining a longitudinal edge portion of said stringer tape;

(b) a row of successively interconnected elongated loops formed from a plastic filament and woven into said filament woven section, each of said loops having a coupling head at one end thereof, an upper leg and a lower leg extending from said head in a common direction, and a heel portion remote from said head connected to a next adjacent one of said successive loops;

(c) a group of upper binding warp threads extending in parallel longitudinally of said stringer tape, overlying said upper legs of said filament loops and interwoven with said foundation weft thread, a group of lower binding warp threads extending in parallel longitudinally of said stringer tape, underlying said lower legs of said filament loops and interwoven with said foundation weft thread, both said groups of binding warp threads running as a whole substantially along a straight path at the region which extends substantially from the midpoint of each of said upper and lower legs to said heel portions;

(d) a gap-filling warp thread extending parallel with and between an outermost one of said upper binding warp threads and the next adjoining upper binding warp thread and also between an outermost one of said lower binding warp threads and the next adjoining lower binding warp thread, and passing alternately over and under said foundation weft thread, thereby tensioning said foundation weft thread to sink substantially halfway between said upper and lower legs of an adjacent pair of loops; and (e) a plurality of loop-clamping warp threads extending between said upper and lower binding warp threads except said outermost two binding warp threads, and alternately overlying said upper legs and said foundation weft thread and underlying said lower legs and said foundation weft thread at every other adjacent loops.

2. A woven slide fastener stringer according to claim 1, said outermost upper binding warp thread being disposed substantially in registry with said outermost lower binding warp thread to make said foundation weft thread lie substantially perpendicularly to the plane of said fastener stringer between said outermost upper and lower binding warp threads.

3. A woven slide fastener stringer according to claim 1, including a further gap-filling warp thread extending in juxtaposition with said gap-filling warp thread.

4. A woven slide fastener stringer according to claim 1, including a plurality of anchoring warp threads underlying said lower legs adjacent to said coupling heads of said loops and being interwoven with said foundation weft thread.

5. A woven slide fastener stringer according to claim 1, said gap-filling warp thread underlying said lower legs of said filament loops.

6. A woven slide fastener stringer according to claim 1, said loop-clamping warp threads comprising at least one pair of upper and lower loop-clamping warp threads extending in symmetric patterns with each other.

* * * * *